US011279135B2

(12) United States Patent
Miyasaka

(10) Patent No.: US 11,279,135 B2
(45) Date of Patent: Mar. 22, 2022

(54) INK ABSORPTION MEMBER

(71) Applicant: SEIKO EPSON CORPORATION, Tokyo (JP)

(72) Inventor: Yoichi Miyasaka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/041,471

(22) PCT Filed: Jan. 21, 2019

(86) PCT No.: PCT/JP2019/001651
§ 371 (c)(1),
(2) Date: Sep. 25, 2020

(87) PCT Pub. No.: WO2019/187531
PCT Pub. Date: Oct. 3, 2019

(65) Prior Publication Data

US 2021/0008887 A1 Jan. 14, 2021

(30) Foreign Application Priority Data

Mar. 27, 2018 (JP) ..... JP2018-059706

(51) Int. Cl.
*B41J 2/17* (2006.01)
*B41J 2/165* (2006.01)

(52) U.S. Cl.
CPC ..... *B41J 2/16517* (2013.01); *B41J 2/1721* (2013.01)

(58) Field of Classification Search
CPC ..... B41J 2/1721; B41J 2/16523; B41J 2/17
See application file for complete search history.

(56) References Cited

U.S. PATENT DOCUMENTS

| | | | |
|---|---|---|---|
| 6,001,165 | A | 12/1999 | Shibuya et al. |
| 2002/0042237 | A1 | 4/2002 | Sameshima et al. |
| 2019/0224644 | A1 | 7/2019 | Ikemoto et al. |
| 2019/0300629 | A1 | 10/2019 | Ikemoto et al. |
| 2019/0315960 | A1 | 10/2019 | Ikemoto et al. |

FOREIGN PATENT DOCUMENTS

| | | | | | |
|---|---|---|---|---|---|
| EP | 3639802 | A1 | * | 4/2020 | ..... A61F 13/47 |
| JP | H09-158024 | A | | 6/1997 | |
| JP | H10-203054 | A | | 8/1998 | |
| JP | 3536870 | B2 | | 6/2004 | |
| JP | 2009-274302 | A | | 11/2009 | |
| JP | 2020082569 | A | * | 6/2020 | ..... B41J 2/16508 |
| JP | 2020116930 | A | * | 8/2020 | ..... B41J 2/16508 |
| TW | 201641609 | A | | 12/2016 | |
| WO | 2018/008758 | A1 | | 1/2018 | |
| WO | WO-2019187443 | A1 | * | 10/2019 | ..... D21H 19/20 |

* cited by examiner

*Primary Examiner* — Sharon Polk
(74) *Attorney, Agent, or Firm* — Global IP Counselors, LLP

(57) ABSTRACT

An ink absorption member is provided which effectively prevents ink leakage from occurring even when the container storing the ink absorption member falls over. An ink absorption member is to be used to absorb ink. The ink absorption member includes a water-absorbent resin. In a mixture in which an ink is added to the ink absorption member in a ratio of 12 g of the ink to 0.24 g of the ink absorption member, the mixture has a viscosity of 5 Pa·s or greater and 100 Pa·s or less as measured 25 minutes after preparation of the mixture by using a tuning fork vibro viscometer. It is preferable that the water-absorbent resin be in the form of particles or a fiber.

9 Claims, 3 Drawing Sheets

INK ABSORPTION MEMBER

CROSS-REFERENCE TO RELATED APPLICATIONS

This application is a U.S. National stage application of International Patent Application No. PCT/JP2019/001651, filed on Jan. 21, 2019, which claims priority to Japanese Patent Application No. 2018-059706, filed in Japan on Mar. 27, 2018. The entire disclosure of Japanese Patent Application No. 2018-059706 is hereby incorporated herein by reference.

TECHNICAL FIELD

The present invention relates to an ink absorption member.

BACKGROUND ART

In ink jet printers, waste ink is typically generated during a head cleaning operation, which is performed to prevent a reduction in printing quality due to clogging caused by ink, and during an ink filling operation after a replacement of an ink cartridge. Accordingly, to prevent the occurrence of unintentional adhesion of such waste ink to a mechanism or the like within a printer, a liquid absorption member (ink absorption member) for absorbing waste ink is included.

In the related art, as liquid absorption members (ink absorption members), those that include a natural cellulose fiber and/or a synthetic fiber together with a thermally fusible substance have been used (see Japanese Patent No. 3536870, for example).

SUMMARY

Unfortunately, the liquid absorption members (ink absorption members) of the related art had a low ink penetration property and could not absorb waste ink rapidly and, therefore, presented a problem in that, for example, when the container storing an ink absorption member fell over, ink leakage occurred.

An object of the present invention is to provide an ink absorption member that effectively prevents ink leakage from occurring even when the container storing the ink absorption member falls over.

This object is achieved with the present invention, described below.

An ink absorption member of the present invention is to be used to absorb ink. The ink absorption member includes a water-absorbent resin. In a mixture in which an ink is added to the ink absorption member in a ratio of 12 g of the ink to 0.24 g of the ink absorption member, the mixture has a viscosity of 5 Pa·s or greater and 100 Pa·s or less as measured 25 minutes after preparation of the mixture by using a tuning fork vibro viscometer.

Accordingly, the ink absorption member provided effectively prevents ink leakage from occurring even when the container storing the ink absorption member falls over.

In the ink absorption member of the present invention, it is preferable that the ink absorption member include a fiber in addition to the water-absorbent resin.

In this case, the water-absorbent resin described above can be suitably supported on the fiber, and, consequently, leakage of the water-absorbent resin from the container storing the ink absorption member is more suitably prevented. Furthermore, when ink is applied to the ink absorption member, the fiber can temporarily hold the ink and subsequently deliver the ink to the water-absorbent resin more efficiently. Hence, an ink absorption characteristic of the ink absorption member as a whole is improved. Furthermore, there is an advantage from the standpoint of reducing the cost of producing the ink water-absorbent member.

In the ink absorption member of the present invention, it is preferable that the fiber be a cellulose fiber.

In this case, when ink is applied to the ink absorption member, the ink absorption member can rapidly escape from a state in which a flowability is particularly high, and, in addition, the ink temporarily taken in by the cellulose fiber can be suitably delivered to the water-absorbent resin. As a result, the ink absorption characteristic of the ink absorption member as a whole is particularly enhanced. Furthermore, in general, cellulose has a high affinity for water-absorbent resins, and, therefore, the water-absorbent resin can be more suitably supported on a surface of the fiber.

In the ink absorption member of the present invention, it is preferable that the water-absorbent resin be mixed with the fiber in a ratio of greater than 5 g and 90 g or less of the water-absorbent resin to 100 g of the fiber.

In this case, the effects of the inclusion of the fiber are produced more prominently while the effects of the inclusion of the water-absorbent resin are sufficiently produced.

In the ink absorption member of the present invention, it is preferable that the water-absorbent resin be in a form of particles.

In this case, the ink absorption member can be suitably loaded in a container while an ink penetration property is easily ensured. Furthermore, good conformability to containers of various shapes is achieved, which suitably prevents the formation of an unnecessarily large space in the container. Furthermore, in a case in which the ink absorption member includes a fiber such as those described in detail later, the water-absorbent resin can be suitably supported on a surface of the fiber.

In the ink absorption member of the present invention, it is preferable that the water-absorbent resin be in a form of a fiber.

In this case, the ink absorption member can be suitably loaded in a container while an ink penetration property is easily ensured. Furthermore, good conformability to containers of various shapes is achieved, which suitably prevents the formation of an unnecessarily large space in the container. Furthermore, in a case in which the ink absorption member includes a fiber such as those described in detail later, the water-absorbent resin can be suitably supported on a surface of the fiber.

DESCRIPTION OF EMBODIMENTS

[Ink Absorption Member]

Figure 1:
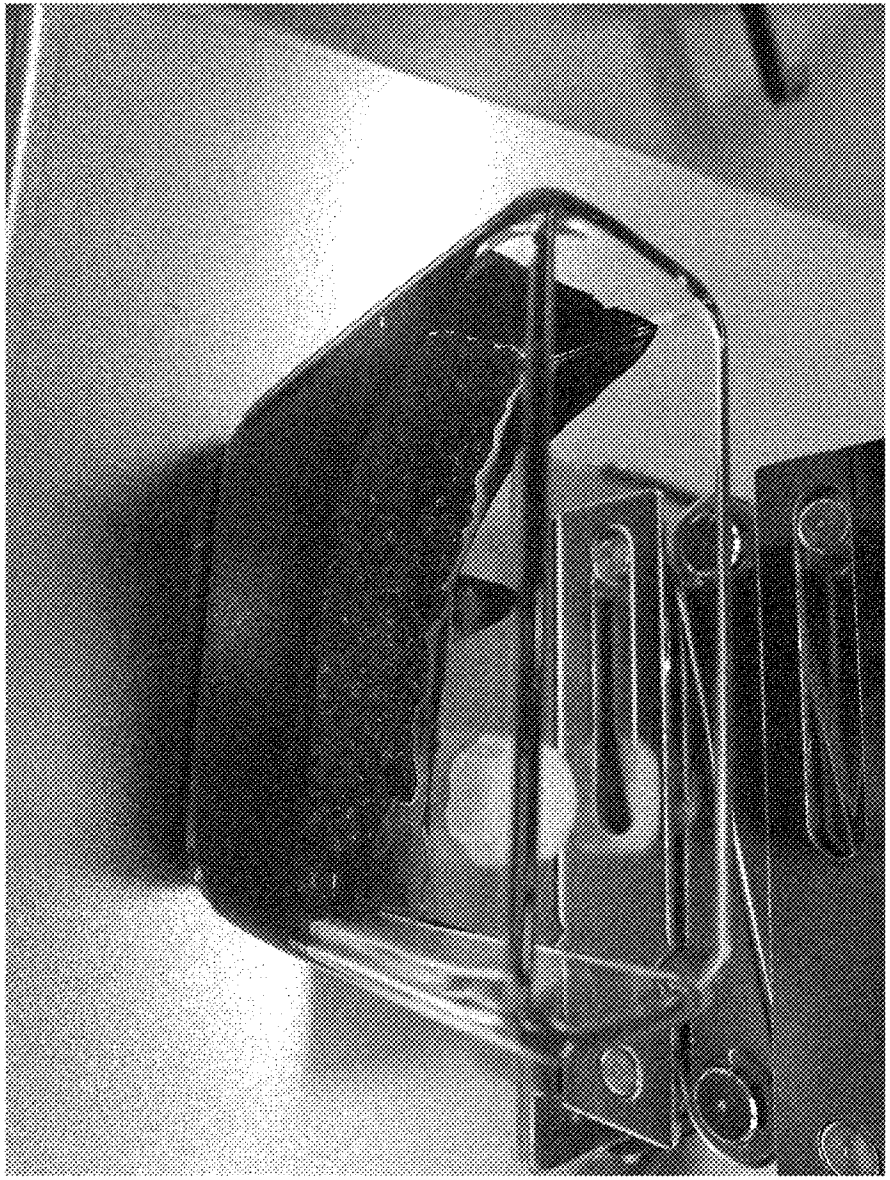
FIG. 1 is a photograph showing, regarding Example 1, a state in which a container containing a mixture of an ink absorption member and an ink was inverted by 90°; the container was inverted at the time when a viscosity of the mixture reached 4.5 Pa·s.

An ink absorption member of the present invention is a member used to absorb ink and includes a water-absorbent resin. In a mixture in which an ink (aqueous ink) is added to the ink absorption member in a ratio of 12 g of the ink to 0.24 g of the ink absorption member, the mixture has a viscosity of 5 Pa·s or greater and 100 Pa·s or less as measured 25 minutes after preparation of the mixture by using a tuning fork vibro viscometer (the viscosity is hereinafter also referred to as a "viscosity after 25 minutes").

Since this condition is satisfied, the ink absorption member provided can suitably absorb ink in a relatively short time and effectively prevents ink leakage from occurring even when the container storing the ink absorption member falls over.

Furthermore, even when an amount (ratio) of ink to be absorbed is relatively large with respect to an amount of the ink absorption member, the ink absorption member can suitably absorb the ink, and, therefore, effects such as those described above are stably produced over a long period of time while an increase in the size of the apparatus in which the ink absorption member is to be included is effectively prevented. Furthermore, the frequency of replacement of the ink absorption member can be reduced, and as a result, maintenance of the apparatus that includes the ink absorption member is easy.

Furthermore, in the related art, a problem was encountered in that when a volume of an ink absorption member (an allowable amount of absorption of ink to be absorbed by an ink absorption member) was large (e.g., when an apparatus had an allowable amount of absorption of ink to be absorbed by an ink absorption member of 1000 $cm^3$ or greater and 4000 $cm^3$ or less) or when an ink absorption member had a large height, solids present in an ink, such as a pigment, formed a film on a surface of the ink absorption member, and, consequently, the ink did not sufficiently penetrate the interior of the ink absorption member, and, therefore, the entirety of the ink absorption member could not be efficiently utilized for the absorption of ink. With the present invention, however, the ink absorption member can be suitably used in an apparatus or the like in which the volume of the ink absorption member (the allowable amount of absorption of ink to be absorbed by an ink absorption member) is relatively large.

Furthermore, since the viscosity after 25 minutes, which is measured with an ink such as that mentioned above, satisfies the predetermined condition, excellent effects such as those described above are produced in a case in which any of a variety of aqueous jet inks (including latex inks) is used.

On the other hand, if the viscosity after 25 minutes is less than the lower limit, the ink absorption member, in a case in which ink has been applied thereto, maintains a high flowability state over a long time; thus, when the container storing the ink absorption member falls over, ink leakage tends to occur.

Furthermore, if the viscosity after 25 minutes is greater than the upper limit, solids present in the ink tend to form a film on the surface of the ink absorption member when the ink is applied to the ink absorption member, and, consequently, the ink cannot sufficiently penetrate the interior of the ink absorption member. As a result, when the container storing the ink absorption member falls over, ink leakage tends to occur.

As described above, it is sufficient that the viscosity after 25 minutes be 5 Pa·s or greater and 100 Pa·s or less. Preferably, however, the viscosity after 25 minutes is 6 Pa·s or greater and 60 Pa·s or less, more preferably 7 Pa·s or greater and 40 Pa·s or less, and even more preferably 8 Pa·s or greater and 25 Pa·s or less. In these cases, effects such as those described above are produced more prominently.

Note that in the present invention, the viscosity is a viscosity at 26° C. (absolute viscosity) unless otherwise specified.

Furthermore, the viscosity after 25 minutes and a 5 Pa·s achievement time, which will be described later, can be suitably adjusted by adjusting any of a variety of conditions, such as the composition of a constituent material of the ink absorption member, a particle diameter of the water-absorbent resin, and the like.

More specific measurement conditions for the viscosity after 25 minutes may be those described below in detail.

That is, in the measurement of the viscosity after 25 minutes, an amount of the ink to be used may be 12 g, and an amount of the ink absorption member to be used may be 0.24 g.

Furthermore, for the measurement of the viscosity after 25 minutes, an ink jet printer ink ICBK-61, manufactured by Seiko Epson Corporation, which has a viscosity of 5 mPa·s, may be used as the ink.

Furthermore, a temperature during the measurement of the viscosity after 25 minutes may be 26° C.±1° C.

Furthermore, as the tuning fork vibro viscometer and the container, an SV-A series, manufactured by A&D Company, Limited, may be used (e.g., the viscometer may be an SV-100H, and the container may be a model AX-SV-35 glass container capacity <borosilicate glass, approximately 13 mL>).

Furthermore, in the measurement, the frequency of vibration of the vibrators may be 30 Hz.

Furthermore, in the measurement, the amplitude of vibration of the vibrators may be less than or equal to 1 mm.

In the case in which the viscosity of a mixture in which 12 g of an ink having a viscosity of 5 mPa·s is added to 0.24 g of the ink absorption member is measured by using a tuning fork vibro viscometer, the time that it takes for the viscosity of the mixture to reach 5 Pa·s (the time that elapses after the preparation of the mixture, hereinafter also referred to as a "5 Pa·s achievement time") is preferably 1 minute or greater and 20 minutes or less, more preferably 2 minutes or greater and 15 minutes or less, and even more preferably 3 minutes or greater and 10 minutes or less.

In these cases, the ink absorption member can suitably absorb ink in a relatively short time and more effectively prevents ink leakage from occurring even when the container storing the ink absorption member falls over.

Furthermore, even when the amount (ratio) of ink to be absorbed is relatively large with respect to the amount of the ink absorption member, the ink absorption member can suitably absorb ink.

Furthermore, the ink absorption member can be suitably used in an apparatus or the like in which the volume of the ink absorption member (the allowable amount of absorption of ink to be absorbed by an ink absorption member) is relatively large.

On the other hand, if the 5 Pa·s achievement time is less than the lower limit, solids present in the ink tend to form a film on the surface of the ink absorption member in some cases, depending on, for instance, the amount of ink applied to the ink absorption member, and, consequently, the ink may not sufficiently penetrate the interior of the ink absorption member.

Furthermore, if the 5 Pa·s achievement time is greater than the upper limit, the time necessary for a flowability of the ink absorption member to which the ink has been applied to be sufficiently reduced tends to be prolonged in some cases, depending on, for instance, the amount of ink applied to the ink absorption member.

Note that more specific measurement conditions for the 5 Pa·s achievement time may be similar to the measurement conditions for the viscosity after 25 minutes described above.

Constituent materials for the ink absorption member of the present invention will now be described.

<Water-Absorbent Resin>

The water-absorbent resin, which is a constituent component of the ink absorption member, is not particularly limited provided that the resin has water absorbency. Examples of the water-absorbent resin include carboxymethyl cellulose, polyacrylic acids, polyacrylamides, starch-acrylic acid graft copolymers, hydrolysates of starch-acrylonitrile graft copolymers, vinyl acetate-acrylic ester copolymers, isobutylene-maleic acid copolymers, hydrolysates of acrylonitrile copolymers or acrylamide copolymers, polyethylene oxide, polysulfonic acid compounds, polyglutamic acids, salts (neutralized products) thereof, and crosslinked products thereof. As used herein, the term "water absorbency" refers to the ability to exhibit hydrophilicity and retain water. Many water-absorbent resins form a gel when the resins have absorbed water.

In particular, it is preferable that the water-absorbent resin be a resin having a functional group in a side chain thereof. Examples of the functional group include acid groups, hydroxyl groups, epoxy groups, and amino groups.

In particular, preferably, the water-absorbent resin is a resin having an acid group in a side chain thereof, and, more preferably, the water-absorbent resin is a resin having a carboxyl group in a side chain thereof.

Examples of a carboxyl-group-containing unit that may be included in the water-absorbent resin include units derived from a monomer such as acrylic acid, methacrylic acid, itaconic acid, maleic acid, crotonic acid, fumaric acid, sorbic acid, cinnamic acid, an anhydride of any of these, or a salt of any of these.

In a case in which the ink absorption member includes a water-absorbent resin that contains an acid group in a side chain thereof, a percentage of acid groups that are neutralized and form a salt of all the acid groups present in the water-absorbent resin is preferably 30 mol % or greater and 100 mol % or less, more preferably 50 mol % or greater and 95 mol % or less, even more preferably 60 mol % or greater and 90 mol % or less, and most preferably 70 mol % or greater and 80 mol % or less.

In these cases, the ink absorption member has a further enhanced ink absorption property.

The type of the neutralized salt is not particularly limited, and examples thereof include alkali metal salts, such as sodium salts, potassium salts, and lithium salts, and salts of a nitrogen-containing basic compound, such as ammonia. A sodium salt is preferable.

In this case, the ink absorption member has a further enhanced ink absorption property.

A water-absorbent resin that contains an acid group in a side chain thereof is preferable because in such a water-absorbent resin, electrostatic repulsion occurs between acid groups during the absorption of ink, which increases the absorption rate. Furthermore, in the case in which acid groups are neutralized, ink can be easily absorbed into the water-absorbent resin under osmotic pressure.

The water-absorbent resin may include a structural unit that contains no acid group. Examples of such a structural unit include hydrophilic structural units, hydrophobic structural units, and structural units that serve as a polymerizable crosslinking agent.

Examples of the hydrophilic structural units include structural units derived from a nonionic compound, such as acrylamide, methacrylamide, N-ethyl (meth)acrylamide, N-n-propyl (meth)acrylamide, N-isopropyl (meth)acrylamide, N,N-dimethyl (meth)acrylamide, 2-hydroxyethyl (meth)acrylate, 2-hydroxypropyl (meth)acrylate, methoxypolyethylene glycol (meth)acrylate, polyethylene glycol mono(meth)acrylate, N-vinylpyrrolidone, N-acryloylpiperidine, or N-acryloylpyrrolidine.

Examples of the hydrophobic structural units include structural units derived from a compound such as (meth) acrylonitrile, styrene, vinyl chloride, butadiene, isobutene, ethylene, propylene, stearyl (meth)acrylate, or lauryl (meth) acrylate.

Examples of the structural units that serve as a polymerizable crosslinking agent include structural units derived from, for instance, diethyleneglycol diacrylate, N,N'-methylenebisacrylamide, polyethylene glycol diacrylate, polypropylene glycol diacrylate, trimethylolpropane diallyl ether, trimethylolpropane triacrylate, allyl glycidyl ether, pentaerythritol triallyl ether, pentaerythritol diacrylate monostearate, bisphenol diacrylate, isocyanurate diacrylate, tetraallyloxyethane, or a salt of diallyloxyacetic acid.

From the standpoint of absorption performance, cost, and the like, it is preferable that the water-absorbent resin be a polyacrylic acid salt copolymer or a crosslinked polyacrylic acid polymer.

In the crosslinked polyacrylic acid polymer, a percentage of carboxyl-group-containing structural units of all the structural units included in the molecular chain is preferably greater than or equal to 50 mol %, more preferably greater than or equal to 80 mol %, and even more preferably greater than or equal to 90 mold.

If the percentage of the carboxyl-group-containing structural units is too low, it may be difficult to ensure a sufficiently good ink absorption performance.

It is preferable that some of the carboxyl groups in the crosslinked polyacrylic acid polymer be neutralized (partially neutralized) and form a salt.

In the crosslinked polyacrylic acid polymer, a percentage of neutralized carboxyl groups of all the carboxyl groups is preferably 30 mol % or greater and 99 mol % or less, more preferably 50 mol % or greater and 99 mol % or less, and even more preferably 70 mol % or greater and 99 mol % or less.

Furthermore, the water-absorbent resin may have a structure crosslinked with a crosslinking agent other than the polymerizable crosslinking agent mentioned above.

When the water-absorbent resin is a resin containing acid groups, it is preferable that the crosslinking agent be, for example, a compound containing functional groups that are reactive with acid groups.

When the water-absorbent resin is a resin containing functional groups that are reactive with acid groups, it is preferable that the crosslinking agent be a compound containing, in the molecule, functional groups that are reactive with acid groups.

Examples of the compound (crosslinking agent) containing functional groups that are reactive with acid groups include glycidyl ether compounds, such as ethylene glycol diglycidyl ether, trimethylolpropane triglycidyl ether, (poly) glycerol polyglycidyl ether, diglycerol polyglycidyl ether, and propylene glycol diglycidyl ether; polyhydric alcohols, such as (poly)glycerol, (poly)ethylene glycol, propylene glycol, 1,3-propanediol, polyoxyethylene glycol, triethylene glycol, tetraethylene glycol, diethanolamine, and triethanolamine; and polyamines and the like, such as ethylenediamine, diethylenediamine, polyethyleneimine, and hexamethylene diamine. Other preferred examples include ions of a multivalent metal, such as zinc, calcium, magnesium, or aluminum. Such ions serve as a crosslinking agent by reacting with acid groups present in the water-absorbent resin.

In the ink absorption member, the water-absorbent resin may have any shape and may be in the form of, for example, a block (mass), pellets, flakes, needles, a fiber, particles, or the like.

In particular, when the water-absorbent resin is in the form of particles or a fiber, the ink absorption member can be suitably loaded in a container while an ink penetration property is easily ensured. Furthermore, good conformability to containers of various shapes is achieved, which suitably prevents the formation of an unnecessarily large space in the container. Furthermore, in a case in which the ink absorption member includes a fiber such as those described in detail later, the water-absorbent resin can be suitably supported on a surface of the fiber.

An average particle diameter of the particles is preferably 15 μm or greater and 800 μm or less and more preferably 15 μm or greater and 400 μm or less.

In these cases, the viscosity after 25 minutes and the 5 Pa·s achievement time can be adjusted to suitable values more easily, and, consequently, effects such as those described above are produced more reliably.

On the other hand, if the average particle diameter of the particles is too small, the ink penetration property in the interior of the ink absorption member tends to decrease.

Furthermore, if the average particle diameter of the particles is too large, the water-absorbent resin has a reduced specific surface area, which results in a reduced ink absorption characteristic and a reduced ink absorption rate.

Note that in the present invention, the average particle diameter is a volume-based average particle diameter. The average particle diameter can be determined, for example, in a measurement using a particle size distribution analyzer that uses the laser diffraction light scattering method as the measurement principle, that is, a laser diffraction particle size distribution analyzer.

The particles may include one or more components in addition to the water-absorbent resin. Examples of such components include surfactants, lubricants, defoamers, fillers, anti-blocking agents, and UV absorbers.

The water-absorbent resin (e.g., a water-absorbent resin in the form of particles) may have a uniform configuration in its entirety or have different configurations in different locations. For example, in the water-absorbent resin (e.g., a water-absorbent resin in the form of particles), a region near the surface (e.g., a region extending 1 μm in thickness from the surface) may have a higher degree of crosslinking than other locations.

In this case, an ink absorption factor and absorption rate, a strength of the water-absorbent resin, and the like are improved in a more balanced manner.

Furthermore, in the case in which the ink absorption member includes a fiber, adhesion (bonding strength) between the water-absorbent resin and the fiber is further enhanced, and the fiber can deliver the ink temporarily held by the fiber to the water-absorbent resin more efficiently, and, consequently, the ink absorption characteristic of the ink absorption member as a whole is further improved.

In the ink absorption member of the present invention, a content of the water-absorbent resin (a content in a state in which no ink is absorbed; the same applies to the description below) is preferably greater than or equal to 20 mass %, more preferably 30 mass % or greater and 99 mass % or less, and even more preferably 33 mass % or greater and 95 mass % or less.

In these cases, effects such as those described above are produced more prominently.

<Fiber>

It is sufficient that the ink absorption member of the present invention include at least a water-absorbent resin; additionally, the water-absorbent resin may have a shape in the form of a fiber. Furthermore, a fiber (a fiber formed of a material other than a water-absorbent resin) may be included.

In this case, the water-absorbent resin described above can be suitably supported on the fiber, and, consequently, leakage of the water-absorbent resin from the container storing the ink absorption member is more suitably prevented. Furthermore, when ink is applied to the ink absorption member, the fiber can temporarily hold the ink and subsequently deliver the ink to the water-absorbent resin more efficiently. Hence, the ink absorption characteristic of the ink absorption member as a whole is improved. Furthermore, in general, fibers such as cellulose fibers (in particular, fibers derived from waste paper) are less expensive than the water-absorbent resins described above, and, therefore, such fibers are advantageous also from the standpoint of reducing the cost of producing the ink water-absorbent member. Furthermore, as will be described in detail later, as the fiber, a fiber derived from waste paper can be suitably used, and, therefore, advantages in terms of waste reduction, effective utilization of resources, and the like are achieved.

Examples of the fiber include synthetic resin fibers, such as polyester fibers and polyamide fibers; and natural resin fibers, such as cellulose fibers, keratinous fibers, and fibroin fibers, and chemical modifications thereof; these may be used alone or in an appropriate combination. Preferably, the fiber is primarily formed of a cellulose fiber (which may be included, for example, in an amount greater than or equal to 70 mass %), more preferably, the fiber is substantially entirely formed of a cellulose fiber.

Cellulose is a material having a suitable hydrophilicity, and thus, when ink is applied to the ink absorption member, the ink can be suitably taken in. Hence, the ink absorption member can rapidly escape from a state in which the flowability is particularly high (e.g., a state in which the viscosity is not greater than 10 mPa·s), and, in addition, the ink temporarily taken in can be suitably delivered to the water-absorbent resin. As a result, the ink absorption characteristic of the ink absorption member as a whole is particularly enhanced. Furthermore, in general, cellulose has a high affinity for water-absorbent resins, and, therefore, the water-absorbent resin can be more suitably supported on a surface of the fiber. Furthermore, cellulose fibers are renewable natural materials and are inexpensive and readily available compared with various other fibers. As such, cellulose fibers are advantageous also from the standpoint of reducing the cost of producing the ink absorption member, ensuring stable production, and reducing environmental impact, for example.

Note that in this specification, it is sufficient that the cellulose fiber be a material containing, as a major component, a compound of cellulose (cellulose in a narrow sense) and being in the form of a fiber, and thus the material may include hemicellulose and/or lignin in addition to cellulose (cellulose in a narrow sense).

In the case in which the ink absorption member includes a fiber, the fiber included in the ink absorption member may be one individual fiber or a plurality of individual fibers.

Furthermore, in the ink absorption member, a plurality of individual fibers may exist discretely from one another, for example. Furthermore, in the ink absorption member, the fiber may be included in the form of cotton, for example. Furthermore, the fiber may be a material formed to have a sheet shape, a strip shape, a small piece shape, or the like, for example.

In the ink absorption member, it is preferable that the fiber support the water-absorbent resin on a surface of the fiber.

In this case, leakage of the water-absorbent resin from the container storing the ink absorption member is more suitably prevented. Furthermore, when ink is applied to the ink absorption member, the fiber can temporarily hold the ink and subsequently deliver the ink to the water-absorbent resin more efficiently. Hence, the ink absorption characteristic of the ink absorption member as a whole is improved.

A raw material for the fiber may be waste paper, for example.

This enables effects such as those described above to be produced and is preferable also from the standpoint of resource saving.

In a case in which waste paper is used as a raw material for the fiber, the waste paper may be unprocessed waste paper or may be a shredded material obtained from a shredding process or a fiberized material obtained from a fiberization process.

An average length of the fiber is not particularly limited and is preferably 0.1 mm or greater and 7 mm or less, more preferably 0.1 mm or greater and 5 mm or less, and even more preferably 0.2 mm or greater and 3 mm or less.

In these cases, the water-absorbent resin can be supported more suitably, and ink can be held and delivered to the water-absorbent resin by the fiber more suitably, and, therefore, the ink absorption characteristic of the ink absorption member as a whole is further enhanced.

An average width (diameter) of the fiber is not particularly limited and is preferably 0.5 μm or greater and 200 μm or less and more preferably 1.0 μm or greater and 100 μm or less.

In these cases, the water-absorbent resin can be supported more suitably, and ink can be held and delivered to the water-absorbent resin by the fiber more suitably, and, therefore, the ink absorption characteristic of the ink absorption member as a whole is further enhanced.

An average aspect ratio (the ratio of the average length to the average width) of the fiber is not particularly limited and is preferably 10 or greater and 1000 or less and more preferably 15 or greater and 500 or less.

In these cases, the water-absorbent resin can be supported more suitably, and ink can be held and delivered to the water-absorbent resin by the fiber more suitably, and, therefore, the ink absorption characteristic of the ink absorption member as a whole is further enhanced.

Furthermore, in the case in which the water-absorbent resin is in the form of particles, it is preferable that a relationship of $0.15 \leq L/D \leq 467$ be satisfied where D is the average particle diameter [μm] of the water-absorbent resin, and L is the average length [μm] of the fiber; more preferably, a relationship of $0.25 \leq L/D \leq 333$ is satisfied, and even more preferably, a relationship of $2 \leq L/D \leq 200$ is satisfied.

In these cases, the water-absorbent resin can be supported more suitably, and ink can be held and delivered to the water-absorbent resin by the fiber more suitably, and, therefore, the ink absorption characteristic of the ink absorption member as a whole is further enhanced.

In the ink absorption member of the present invention, a content of the fiber is preferably 0.5 mass % or greater and 80 mass % or less, more preferably 1.0 mass % or greater and 70 mass % or less, and even more preferably 3.0 mass % or greater and 67 mass % or less.

In these cases, the effects of the inclusion of the fiber are produced more prominently while the effects of the inclusion of the water-absorbent resin, such as those described above, are sufficiently produced.

A content of the water-absorbent resin may be greater than 5 wt. % and 90 wt. % or less relative to a weight of the fiber; in this case, the effects of the present invention can be produced. Preferably, the content is 20 wt. % or greater and 70 wt. % or less relative to the weight of the fiber and more preferably within a range of 40 wt. % or greater and 55 wt. % or less relative to the weight of the fiber.

In these cases, the effects of the inclusion of the fiber are produced more prominently while the effects of the inclusion of the water-absorbent resin, such as those described above, are sufficiently produced.

<Other Components>

The ink absorption member may include one or more components (other components) in addition to the ones described above.

Examples of such components include surfactants, lubricants, defoamers, fillers, anti-blocking agents, UV absorbers, colorants, such as pigments and dyes, flame retardants, and flow improvers.

In the ink absorption member, a content of the other components is preferably less than or equal to 10 mass % and more preferably less than or equal to 5.0 mass %.

It is sufficient that ink absorption members of the present invention have a functionality to absorb ink. For example, the ink absorption members include ones used to absorb waste ink generated during a head cleaning operation, which is performed to prevent a reduction in printing quality due to clogging caused by ink, or during an ink filling operation after a replacement of an ink cartridge; further, the ink absorption members include, for instance, ones used to absorb ink leaked from a flow path of a printing apparatus.

The above description describes preferred embodiments of the present invention. However, the present invention is not limited to the embodiments described above.

EXAMPLES

Specific examples of the present invention will now be described.

[1] Production of Ink Absorption Member

Example 1

First, a crosslinked polyacrylic acid polymer (partial sodium salt crosslinked product), which is a resin (water-absorbent resin) having, in a side chain thereof, a carboxyl group as an acid group, was prepared; namely, Sanfresh ST-250* (manufactured by Sanyo Chemical Industries, Ltd.) was prepared.

Next, Sanfresh ST-250* was subjected to particle size adjustment, and thus a powder having an average particle diameter of 350 μm was obtained as a water-absorbent resin.

The water-absorbent resin (in which the particle size was adjusted) obtained in this manner was used as an ink absorption member.

Example 2

First, as in Example 1, a powder in which the particle size was adjusted and which had an average particle diameter of 350 μm was obtained as a water-absorbent resin.

100 parts by mass of the water-absorbent resin was mixed with the entirety of 200 parts by mass of shredded waste paper, which had been separately prepared as a cellulose fiber, and then water was sprayed onto the mixture by using a spray. Subsequently, the resultant was subjected to a drying process at 50° C. for 24 hours. Thus, an ink absorption member was obtained. Note that the fiber had an average length of 2 mm, an average width of 50 μm, and an aspect ratio (average length/average width) of 20.

In the ink absorption member obtained in this manner, the water-absorbent resin was supported on a surface of the fiber (shredded waste paper).

Example 3

An ink absorption member was produced as in Example 2 except that the mixing ratio between the water-absorbent resin and the fiber was changed as indicated in Table 1.

The conditions for the ink absorption member of each of the examples are summarized in Table 1. Furthermore, the viscosity after 25 minutes and the 5 Pa·s achievement time of the ink absorption member of each of the examples are also shown in Table 1.

Specific measurement conditions for the viscosity after 25 minutes and the 5 Pa·s achievement time are as follows.

That is, in the measurements of the viscosity after 25 minutes and the 5 Pa·s achievement time, the amount of ink used was 12 g, and the amount of the ink absorption member used was 0.24 g.

Furthermore, for the measurements of the viscosity after 25 minutes and the 5 Pa·s achievement time, an ink jet printer ink ICBK-61, manufactured by Seiko Epson Corporation, was used as the ink.

Furthermore, a temperature during the measurements of the viscosity after 25 minutes and the 5 Pa·s achievement time was 26° C.±1° C.

Furthermore, the tuning fork vibro viscometer used for the measurements of the viscosity after 25 minutes and the 5 Pa·s achievement time was an SV-100H, manufactured by A&D Company, Limited. The container (a container for storing the ink absorption member and the ink) used was a model AX-SV-35 glass container (borosilicate glass, approximately 13 mL) from the same company.

Furthermore, in the measurements, the frequency of vibration of the vibrators was 30 Hz, and, in the measurements, the amplitude of vibration of the vibrators was less than or equal to 1 mm.

TABLE 1

| | Water-absorbent resin | | | | |
|---|---|---|---|---|---|
| | Average particle diameter [μm] | Content [mass %] | Pulp fiber Content [mass %] | Viscosity after 25 minutes [Pa · s] | 5 Pa · s achievement time |
| Example 1 | 350 | 100 | 0 | 12.33 | 8 min 45 sec |
| Example 2 | 350 | 50 | 50 | 10.07 | 11 min 50 sec |
| Example 3 | 350 | 33.3 | 66.6 | 15.05 | 7 min 25 sec |

[2] Evaluation of Leakage Prevention Effect

An experiment was conducted under conditions similar to those for the measurements of the viscosity after 25 minutes and the 5 Pa·s achievement time described above. Immediately after the viscosity reached 4.5 Pa·s, the measurement of the viscosity was stopped, and the container was immediately removed from the meter, and then the container was inverted by 90° to check for the presence or absence of the checking of a spilling of the ink.

Furthermore, an experiment was conducted under conditions similar to those for the measurements of the viscosity after 25 minutes and the 5 Pa·s achievement time described above. Immediately after the viscosity reached 5 Pa·s, the measurement of the viscosity was stopped, and the container was immediately removed from the meter, and then the container was inverted by 90° to check for the presence or absence of the checking of a spilling of the ink.

The results are summarized in Table 2.

TABLE 2

| | Presence or absence of spilling of ink in case where container was inverted by 90° when 4.5 Pa · s was achieved | Presence or absence of spilling of ink in case where container was inverted by 90° when 5 Pa · s was achieved |
|---|---|---|
| Example 1 | Inversion was not performed because there was a flowability | There was no spilling of ink |
| Example 2 | Inversion was not performed because there was a flowability | There was no spilling of ink |
| Example 3 | Inversion was not performed because there was a flowability | There was no spilling of ink |

Thus, as shown in Table 2, it was confirmed that in each of the examples, there was no spilling of ink at the time when 5 Pa·s was achieved.

Figure 2:
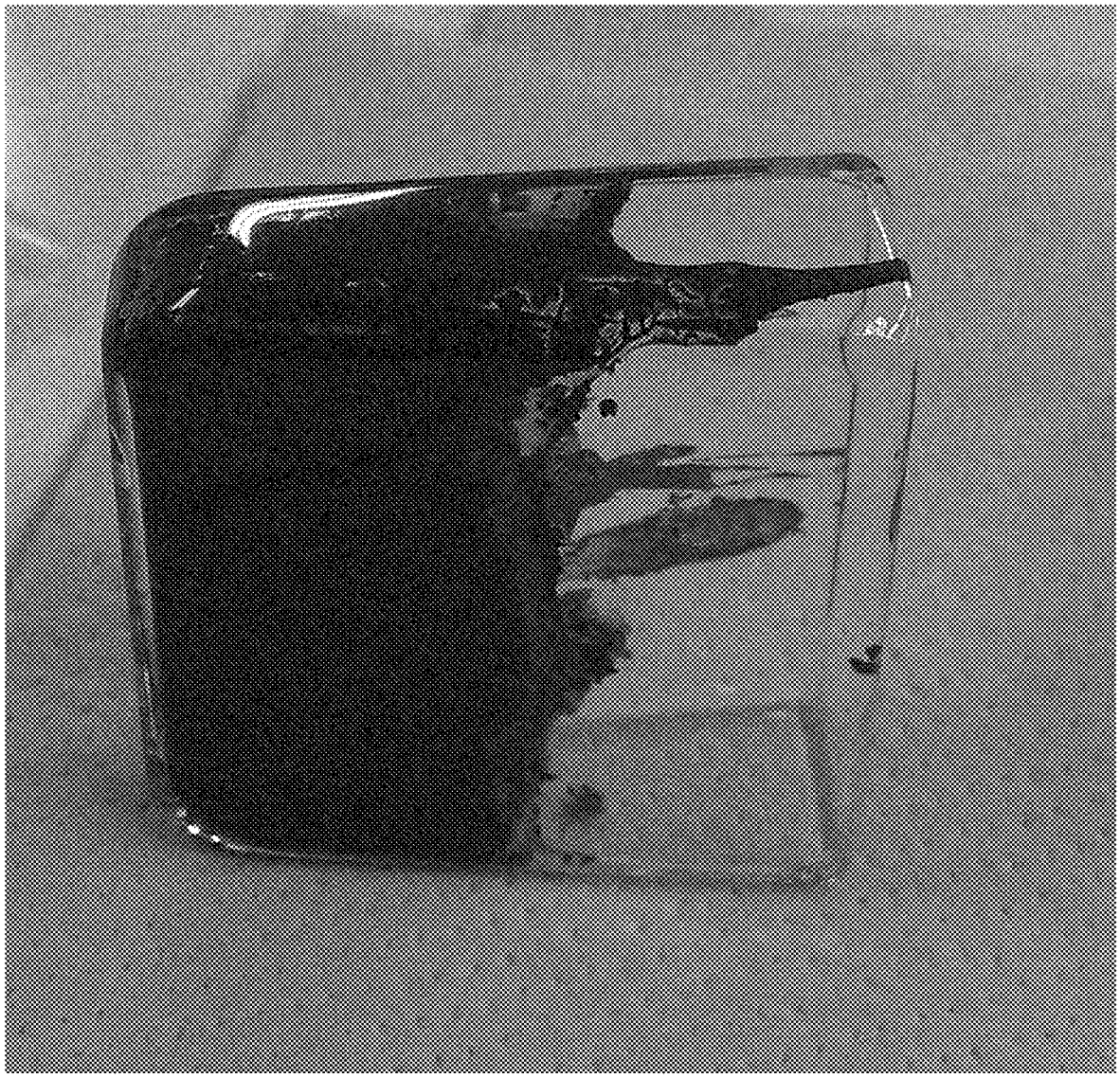
FIG. 2 is a photograph showing, regarding Example 1, a state in which a container containing the mixture of the ink absorption member and the ink was inverted by 90°; the container was inverted at the time when the viscosity of the mixture reached 5 Pa·s.

FIG. 1 shows, regarding Example 1, a state in which the container was inverted by 90°; the container was inverted immediately after 4.5 Pa·s was achieved. Furthermore, FIG. 2 shows, regarding Example 1, a state in which the container was inverted by 90°; the container was inverted immediately after 5 Pa·s was achieved.

Accordingly, it was found that 5 Pa·s or greater for preventing leakage of ink waste liquid from occurring in the event of an inversion can be realized by mixing waste paper with the polymeric absorption member, while recycling, which is environmentally friendly, is realized by the use of waste paper pulp.

Figure 3:
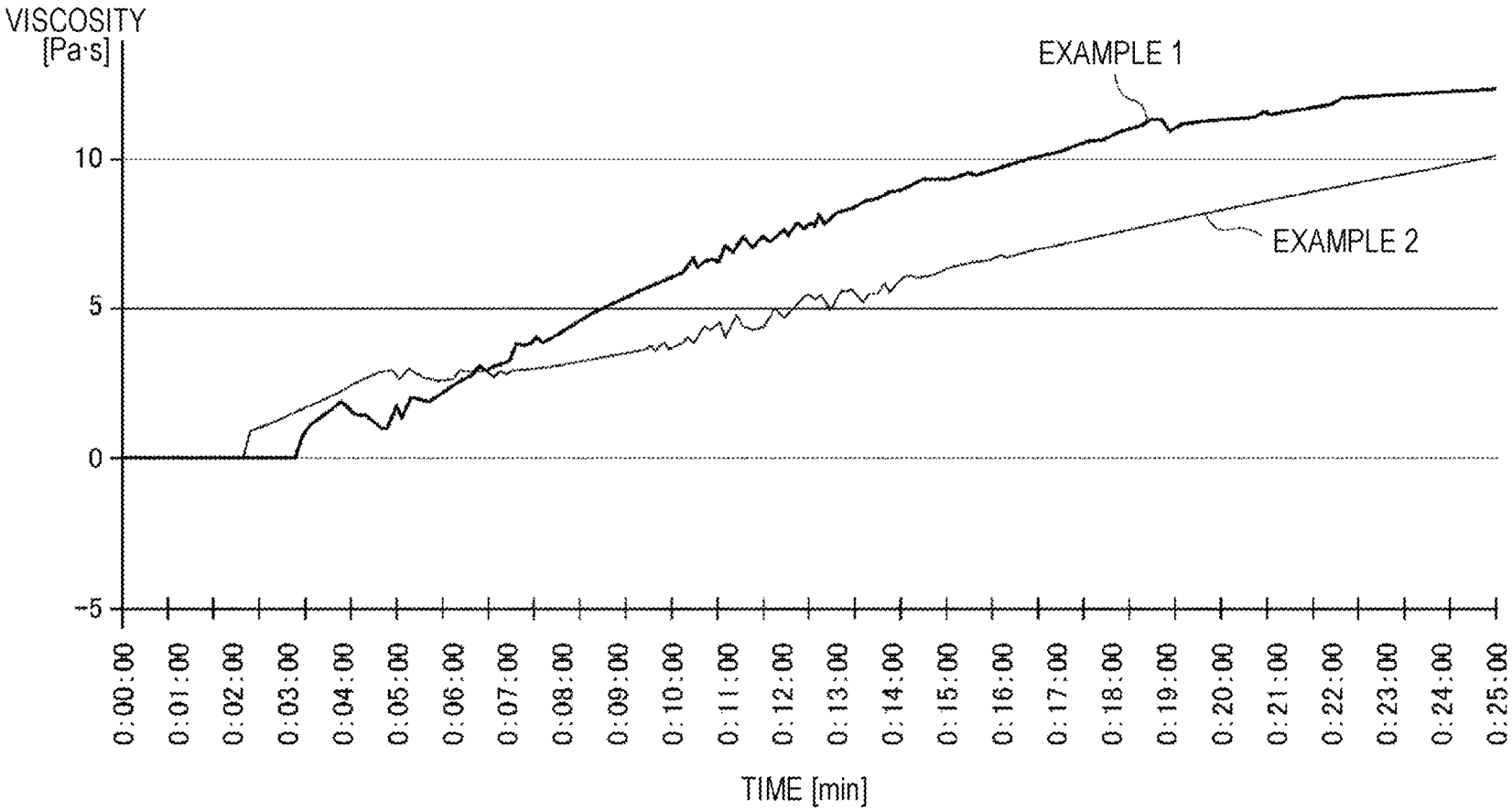
FIG. 3 is a graph illustrating, regarding ink absorption members of Examples 1 and 2, a relationship between the time elapsed since 0.24 g of the ink absorption member was mixed with 12 g of the ink and the viscosity of the mixture of the ink absorption member and the ink.

Note that FIG. 3 illustrates, regarding the ink absorption members of Examples 1 and 2, a relationship between the time elapsed since 0.24 g of the ink absorption member was mixed with 12 g of the ink, the time elapsed since the mixing with the ink, and the viscosity of the mixture of the ink absorption member and the ink.

The invention claimed is:

1. An ink absorption member to be used to absorb ink, the ink absorption member comprising a water-absorbent resin, wherein in a mixture in which an ink is added to the ink absorption member in a ratio of 12 g of the ink to 0.24 g of the ink absorption member, the mixture has a viscosity of 5 Pa·s or greater and 100 Pa·s or less as measured 25 minutes after preparation of the mixture by using a tuning fork vibro viscometer.

2. The ink absorption member according to claim 1, wherein the ink absorption member includes a fiber in addition to the water-absorbent resin.

3. The ink absorption member according to claim 2, wherein the fiber is a cellulose fiber.

4. The ink absorption member according to claim 3, wherein the water-absorbent resin is mixed with the fiber in a ratio of greater than 5 g and 90 g or less of the water-absorbent resin to 100 g of the fiber.

5. The ink absorption member according to claim 4, wherein the water-absorbent resin is in a form of particles.

6. The ink absorption member according to claim 5, wherein the water-absorbent resin is in a form of a fiber.

7. The ink absorption member according to claim 2, wherein the water-absorbent resin is mixed with the fiber in a ratio of greater than 5 g and 90 g or less of the water-absorbent resin to 100 g of the fiber.

8. The ink absorption member according to claim 1, wherein the water-absorbent resin is in a form of particles.

9. The ink absorption member according to claim 1, wherein the water-absorbent resin is in a form of a fiber.

* * * * *